United States Patent [19]

Rorden

[11] 3,967,201

[45] June 29, 1976

[54] WIRELESS SUBTERRANEAN SIGNALING METHOD

[75] Inventor: Louis H. Rorden, Menlo Park, Calif.

[73] Assignee: Develco, Inc., Sunnyvale, Calif.

[22] Filed: Jan. 25, 1974

[21] Appl. No.: 436,540

[52] U.S. Cl. ..... 325/28; 179/82

[51] Int. Cl.[2] ..... H04B 13/02

[58] Field of Search ..... 325/26, 28; 179/82; 340/2, 4, 5 R; 324/1, 5, 6, 7, 8, 10

[56] References Cited

UNITED STATES PATENTS

| | | | |
|---|---|---|---|
| 2,653,220 | 9/1953 | Bays | 325/28 |
| 3,333,239 | 7/1967 | Silverman | 325/28 X |
| 3,495,209 | 2/1970 | Engle | 179/82 X |

FOREIGN PATENTS OR APPLICATIONS

| | | | |
|---|---|---|---|
| 160,430 | 8/1921 | United Kingdom | 325/28 |
| 264,281 | 1/1927 | United Kingdom | 325/28 |

OTHER PUBLICATIONS

Raytheon Electronic Progress: vol. 8, No. 2; Winter 1964; pp. 4–10, "Deep Rock Strata Communication", Debettencourt.

*Primary Examiner*—Benedict V. Safourek
*Attorney, Agent, or Firm*—Lowhurst & Aine

[57] ABSTRACT

A relatively low frequency wireless electromagnetic communication link is established through a subterranean lossy medium such as ground or water by launching and propagating magnetic waves of generally vertical magnetic polarization through the intervening subterranean region of earth or water between a pair of magnetic dipole antennas. A suitable subterranean dipole magnetic antenna includes an elongated electrical solenoid having a ferromagnetic core, as of ferrite or laminated iron. Relatively low frequency magnetic waves are utilized wherein the frequency is related to the conductivity of the subterranean region and distance between transmitter and receiver such that the range is less than 10 skin depths at the carrier frequency.

28 Claims, 8 Drawing Figures

$$P_T = \frac{64\pi^2 k\, T_n\, M r^6 B^3}{f^2 S_R S_T |\Gamma|^2}$$

WIRELESS SUBTERRANEAN SIGNALING METHOD

BACKGROUND OF THE INVENTION

The present invention relates in general to wireless subterranean electromagnetic signaling methods and more particularly to an improved method employing vertically polarized magnetic solenoidal antennas and relatively low frequencies, typically between 1 Hz and 1MHz.

DESCRIPTION OF THE PRIOR ART

Heretofore, wireless subterranean signaling methods have been proposed wherein electromagnetic waves of relatively low frequencies, as of 100Hz to 100KHz, have been propagated between horizontally polarized electric dipole antennas embedded in the earth. One such system is disclosed in U.S. Pat. No. 2,992,325 issued July 11, 1961.

The aforecited U.S. Patent also suggested that the electric dipole antennas could be replaced by air core loop antennas with "equally good effect". It was suggested that the loop antennas could be gotten into the hole in the earth through a passageway connecting the hole with the surface. It was suggested that the hole could be made by lowering an explosive to the bottom of a passageway and then setting it off. The resultant debris could then be scooped out and carried to the surface to make a room for the antenna. The antennas would be lowered into the hole in a collapsed condition and then expanded to full diameter once inside the room or hole.

One problem with the suggested loop antenna alternative is that a considerable amount of expensive excavation is required to position the air core loop antennas. Moreover, such loop antennas, as suggested, were horizontally polarized for picking up horizontally polarized magnetic components of the electromagnetic wave and as such they are more susceptible to picking up horizontal magnetic field components of atmospheric generated noise tending to propagate along the surface of the earth as surface or ground waves. Also, due to the air core of the loop antennas, they must of necessity be relatively large, i.e., too large to fit within a typical bore hole as employed for oil exploration and production.

While a subterranean communication link can be established utilizing large electric dipole antennas for propagating electric waves it has been discovered that a magnetic dipole is considerably more efficient for communication purposes than an equivalent electric dipole.

It has also been proposed in the prior art to employ a buried loop antenna for generating a horizontally polarized magnetic wave which in-turn generates a surface wave having a vertically polarized electric component to be received by a vertical whip receiving antenna. Such a system is disclosed in U.S. Pat. No. 2,989,621 issued June 20, 1961.

It is also known from the prior art to employ a vertically polarized electric dipole antenna embedded deep in the earth for transmitting electromagnetic wave energy to be detected at the surface. Typically these detecting schemes have employed a pair of ground pickup electrodes, at the surface, which are radially spaced from the axis of the electric dipole antenna. It has also been proposed in such a scheme to use a loop antenna for receiving the electromagnetic wave energy transmitted from the electric dipole. Such an apparatus for logging drill holes is disclosed in U.S. Pat. No. 2,225,668 issued Dec. 24, 1940.

These latter two proposed systems would generate horizontal electromagnetic waves of magnetic polarization requiring that a receiving dipole loop antenna be similarly horizontally polarized. This means that the loop should preferably be disposed in the vertical plane which is relatively difficult of support and erection, especially when loop antennas of large enclosed area are required.

SUMMARY OF THE PRESENT INVENTION

The principal object of the present invention is the provision of an improved wireless subterranean signaling method.

In one feature of the present invention, a wireless communication link is established through a subterranean region of earth or water between a pair of magnetic dipole antennas in spaced apart relation, at least one of the antennas being of vertical magnetic polarization and placed in a subterranean or underwater location. An electromagnetic wave is launched and propagated between the antennas through the intervening region of earth or water.

In another feature of the present invention the magnetic dipole antenna which is embedded in the earth at a subterranean location, includes a ferromagnetic core surrounded by a solenoidal electrical winding.

In another feature of the present invention, the pair of spaced magnetic dipole antennas are generally axially parallel.

In another feature of the present invention, the pair of magnetic antennas are spaced apart by a distance within the range of 1 – 10 skin depths in the intervening region of earth or water at the frequency of the electromagnetic wave energy.

In another feature of the present invention, one of the magnetic antennas is located within at least a partially steel cased generally vertical bore hole in the earth's crust.

Other features and advantages of the present invention will become apparent upon a perusal of the following specification taken in connection with the accompanying drawings wherein:

DESCRIPTION OF THE PREFERRED EMBODIMENTS

Figure 1:
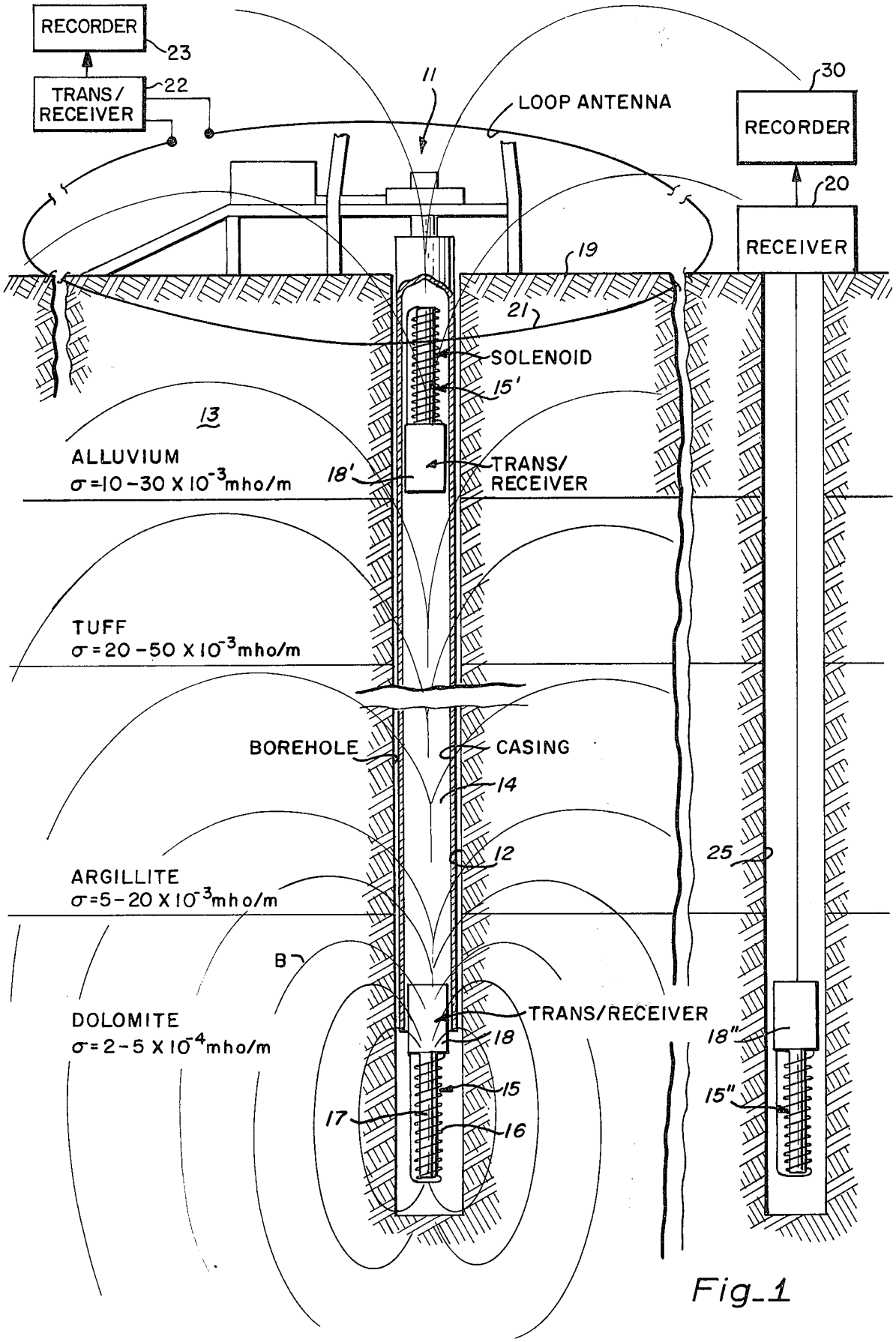
FIG. 1 is a foreshortened longitudinal sectional view, partly in block diagram form, of a wireless subterranean signaling system incorporating features of the present invention.

Referring now to FIG. 1, there is shown a subterranean wireless signaling system utilizing the method of the present invention. More particularly, a conventional drilling rig 11 is employed for drilling a bore hole 12 in the earth's crust 13 to a substantial depth as of 11,000 feet or more. The bore hole 12 is at least partially cased, i.e., cased to a substantial depth with a conventional steel casing 14.

While the method of the present invention will be described utilizing a casing 14 it is to be understood that the casing is not a requirement but is illustrated since bore holes to a great depth, as utilized for drilling deep oil wells, often employ casing as the well is drilled. The communication system of the present invention is useful with or without the casing but communication is more difficult in the presence of casing.

In a typical example, the bore hole 12 is cased to a depth as of 400 feet with casing of an outside diameter of 13.375 inches with a 0.38 inch steel wall thickness, a middle casing section of 9.625 inches diameter with a 0.395 inch wall extending from 400 to 8000 feet and a lower casing section having an outside diameter of 7 inches with a 0.5 inch wall and extending from 8000 to 11,000 feet. In a given well, the number of casings and the depth to which each extends is a function of the geology and discontinuities of hydrostatic pressure encountered in the drilling operation.

A first solenoidal antenna 15 is embedded in the earth's crust 13 by being lowered to a substantial depth, as of 11,000 feet, inside the bore hole 12. The solenoidal antenna 15, in a typical example, includes a solenoidal electrical winding 16, as of 3 inches inside diameter wound over the outside of a fiberglass coil form having a 3 inch inches outside diameter and ½ inch wall thickness. The coil form contains a plurality of closely packed ⅝ inch diameter ferrite rods of circular cross section forming a ferromagnetic core 17. The overall length of the solenoid 16 and core 17 is approximately 10 feet. The ferrite rods are potted in a high density polyurethane foam and the solenoidal winding is covered with an insulating material and then with a metallic coated mylar shield. The solenoidal winding core assembly is potted into a 5½ OD ½ inch wall fiberglass tube.

A transceiver 18 is electrically connected to the solenoidal winding 16 for transmitting and receiving electromagnetic energy via the antenna 15. Suitable matching networks are provided for matching the impedance of the transceiver 18 to the impedance of the antenna 15.

A second antenna 15' and a second transceiver 18', which may be identical to the first transceiver 18 and antenna 15, is located at or near the surface of the earth 19. For example, the upper antenna 15' may be embedded to a relatively shallow depth, as of 10 or 500 feet, to reduce the effect of atmospheric noise on the antenna 15'. As an alternative a loop of insulated wire 21 may be laid out on the surface of the earth 19 in a generally circular configuration coaxial with the bore hole 12, or offset from it by a distance smaller than the depth of the lower antenna 15. In a typical example, the circular loop 21 forms a loop antenna and has a diameter of 1000 to 3000 feet of No. 10AWG insulated wire. In case the antenna 21 at the surface is used only for receiving and not for transmitting its diameter can be reduced substantially such as to a few feet. A transceiver 22 is connected to the loop antenna 21 for transmitting and receiving electrical signals therefrom. A recorder 23 is connected to the output of the receiver portion for recording electrical signals received thereon.

It has been discovered that the magnetic dipole antennas 15 and 21 provide a more efficient method for transmission of relatively low frequency electromagnetic wave energy through a lossy medium, such as the earth's crust or water, than the previously proposed electric dipole antennas. It will be subsequently shown that, in addition to the preferred use of magnetic dipole antennas, there is an optimum transmission frequency in the absence of external noise such that the ratio of range to skin depth is approximately 3.86 for parallel antennas 15 at equal elevation and 2.83 for coaxial antennas, 15 and 21 or 15'. Transmitter power required at this optimum frequency is proportional to the tenth power of range, and to the cube of transmission band width if the latter is larger than the natural antenna bandwidth. For the antenna which is to be embedded in the earth's crust, the elongated solenoidal winding upon a ferromagnetic core is greatly preferred to the horizontally polarized air core loop antennas previously suggested in the prior art, such as the aforecited U.S. Pat. No. 2,992,325 and 2,989,621, which required large cavities or rooms to be formed in the earth's surface to accomodate the relatively large loop antennas. The advantage to the elongated solenoidal winding is that it may be placed within a relatively small diameter bore hole 12 which is readily drilled to relatively great depths.

Although the coaxial arrangement of transmitting and receiving antennas yields improved signal-to-noise ratio for a given transmitted power an alternative arrangement is shown in FIG. 1 wherein a parallel bore hole 25 is bored in laterally spaced relation from the first bore hole 12. A solenoidal antenna 15'', together with its associated transceiver 18'' is lowered into this adjacent bore hole 25. This establishes a lateral communication link between the first antenna 15 and the second colateral antenna 15''. A receiver 20 and recorder 30 are disposed at the surface and connected to the transceiver 18'' via a coaxial cable or other suitable transmission line.

Information may be transmitted over the wireless electromagnetic wave communication link by modulating the carrier wave energy in any number of ways. For example in a preferred embodiment the electromagnetic wave energy may be phase modulated in accordance with the information to be transmitted. For example, a sensor may be located at the bottom of the bore hole 12 for sensing temperature, pressure, conductivity of the earth, etc. The sensor provides an analog output which is converted to binary information by means of an analog-to-digital converter. The output of the digital converter is fed to a coder which codes the reading into a binary code. The code is employed for phase modulating the carrier signal. The receiver detects the phase variations, converts this into a binary code which is decoded, and recorded as desired. Alternative modulation schemes would include frequency-shift keying, multiphase pulse code modulation, and analog amplitude or frequency modulation.

In a preferred embodiment, the magnetic dipole antennas 21 or 15' at or near the surface has its magnetic axis generally vertically polarized to discriminate against atmospheric noise which has a predominantly horizontal magnetic polarization. However, in some cases it may be desirable to place the surface antenna 15' or 21 to one side of the axis of the transmitting antenna in which case the magnetic axis of the surface antenna is preferably oriented with its magnetic axis parallel to the magnetic polarization of wave energy to be detected at the surface.

In a case of an underwater communication link, the magnetic dipole antennas in the water need not have a ferromagnetic core if large loops can readily be supported as by a loop laid out on the subsurface floor (ocean floor) or floated in a loop on the surface.

THEORETICAL CONSIDERATIONS

Electromagnetic waves propagating through the atmosphere lose little energy to the medium. However, in a conductive (lossy) medium, such as the earth or water, energy is dissipated through currents that are generated by the electric field component of the wave. This loss results in an appreciable exponential attenuation of field strength with distance. This attenuation is negligible in the atmospheric case.

Either electric or magnetic antennas may be used to couple electromagnetic wave energy into the earth. However, it can be shown that a magnetic dipole is considerably more efficient for communication through a lossy medium than an equivalent electric dipole. Magnetic dipole antennas, for the system of the present invention are preferably constructed of solenoidal windings wound around ferromagnetic core material, such as ferrite rods or laminated iron alloy.

The magnetic field intensity components generated by a magnetic dipole immersed in an infinite homogeneous medium can be expressed in spherical coordinates as $$H_r = \frac{NAI}{4\pi r^3}[1 + j\gamma r](2\cos\theta)\exp(-j\gamma r) \qquad \text{Eq. (1)}$$

$$H_\theta = \frac{NAI}{4\pi r^3}[1 + j\gamma r - \gamma^2 r^2](\sin\theta\exp(-j\gamma r) \qquad \text{Eq. (2)}$$

where N, A, and I are transmitting antenna turns, effective area, and current, respectively, and r is the range. The subscripts $r$ and $\theta$ refer to the radial and transverse components. The $\theta$ component is of interest for an arrangement of transmitting and receiving antennas wherein the antennas are parallel and non-coaxial such as for example at equal elevation ($\sin\theta = 1$), and the $r$ component is of interest for the arrangement of coaxial transmitting and receiving antennas, such as antennas 15 and 15', ($\cos\theta = 1$).

The complex propagation constant, $\gamma$, is expressed in terms of angular frequency, $\omega = 2\pi f$, and the medium properties: conductivity, $\sigma$, permeability, $\mu$, and permittivity, $\epsilon$. For the simplifying conditions $\sigma >> \omega\epsilon$, $$\gamma = (\omega^2\mu\epsilon + j\omega\mu\sigma)^{1/2} \approx (1-j)\frac{(\omega\mu\sigma)^{1/2}}{(2)} \qquad \text{Eq. (3)}$$

The inverse of the real part of $\gamma$ is the skin depth, $\delta$:

$$\delta = \sqrt{\frac{2}{\omega\mu\sigma}}. \qquad \text{Eq. (4)}$$

The magnitude of magnetic field intensity can be expressed in terms of skin depth or an absorption parameter, $\Gamma$, as follows:

$$|H_r|^2 = \frac{(NAI)^2}{(4\pi r^3)}4\exp(-2r/\delta)[1 + 2r/\delta + 2(r/\delta)^2]\cos^2\theta$$
$$= \frac{(NAI)^2}{(4\pi r^3)}|\Gamma_r|^2 \qquad \text{Eq. (5)}$$

and $$|H_\theta|^2 = \frac{(NAI)^2}{(4\pi r^3)}\exp(-2r/\delta)[1 + 2r/\delta + 2(r/\delta)^2 + 4(r/\delta)^3 + 4(r/\delta)^4]\sin^2\theta$$
$$= \frac{(NAI)^2}{(4\pi r^3)}|\Gamma_\theta|^2. \qquad \text{Eq. (6)}$$

Figure 2:
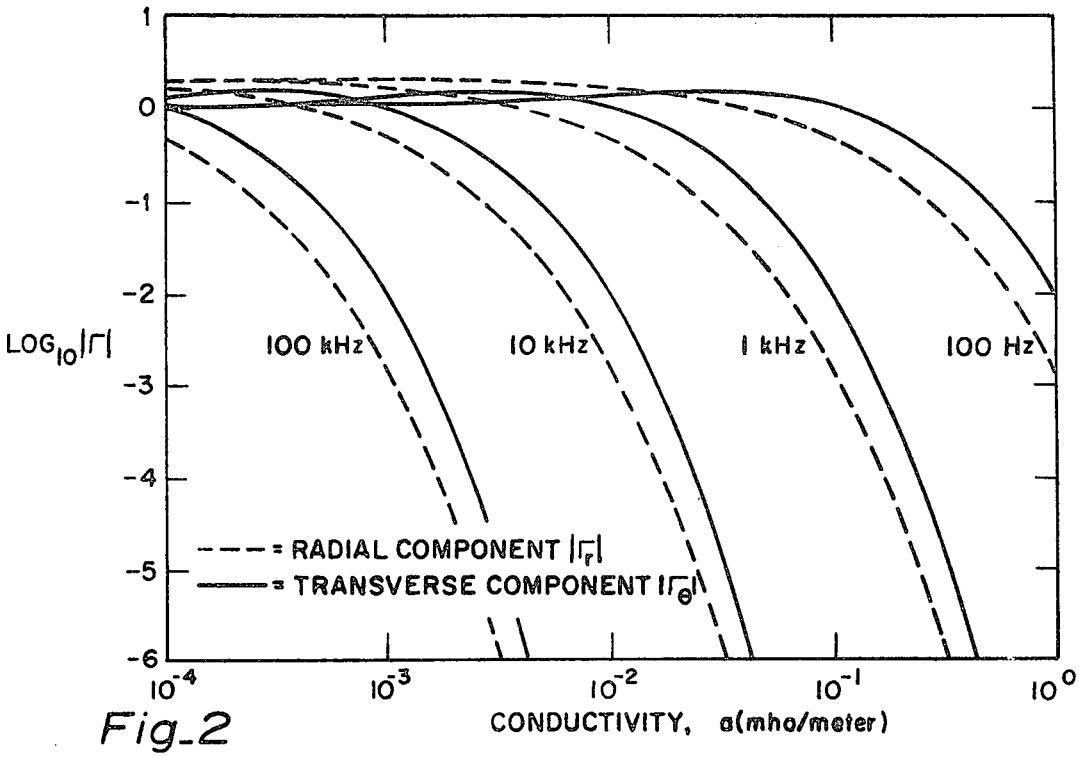
FIG. 2 is a plot of absorption parameter $|\Gamma|$ versus conductivity $\sigma$ for a 500-meter range of communication.
Figure 3:
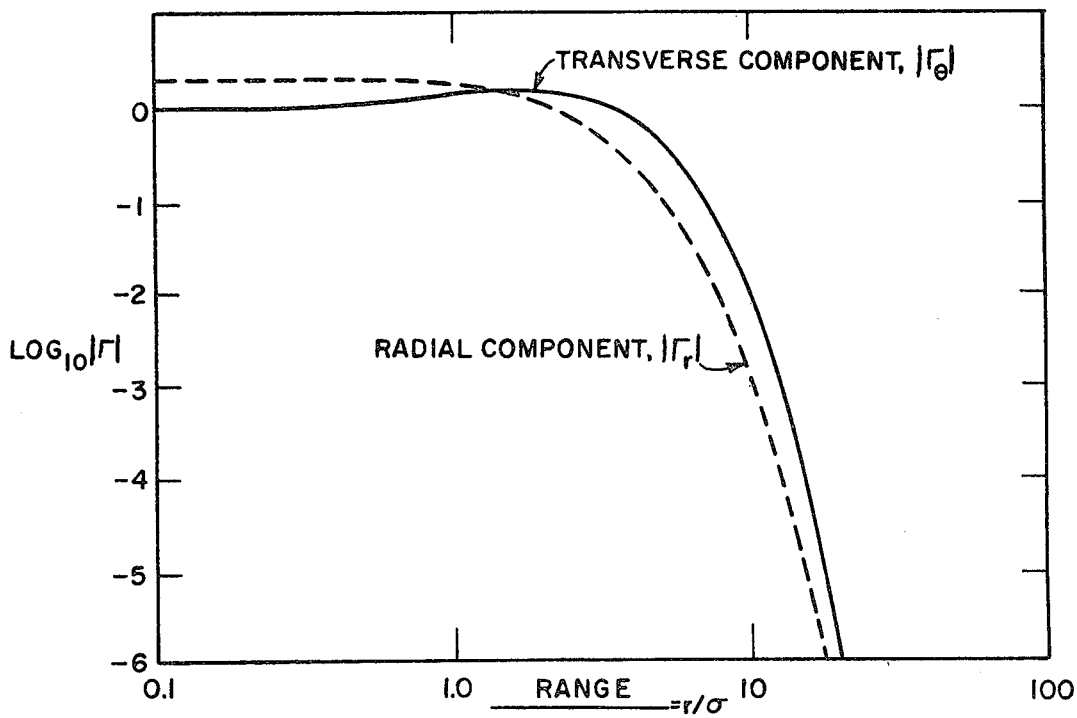
FIG. 3 is a plot of absorption parameter $|\Gamma|$ versus ratio of range to skin depth.

Variation of magnetic field intensity with conductivity, frequency, and the ratio of range to skin depth is illustrated by behavior of the absorption parameter, $|\Gamma_r|$ and $|\Gamma_\theta|$, as plotted in FIGS. 2 and 3. The absorption parameter is the ratio of the field intensity available in the conducting medium to that which would be available if the medium were nonconducting.

A non-homogeneous medium, such as the earth, complicates the problem considerably, although it may be solved in principal by introducing space variable values for $\sigma$, $\mu$ and $\epsilon$. However, by considering each stratum to have uniform properties and sharp boundaries, the problem can be handled by matching boundary conditions across discontinuities, or by treating it as an analog of a transmission line with mismatched impedances. As a typical example, various strata are shown in FIG. 1 having various different conductivities. Generally the permeabilities of the strata are reasonably near that of free space.

Frequently the effect of the various strata may be approximated well enough for system design by using a conductivity which is the arithmetic average with respect to length of the various layers. The distance over which the average is taken is the range from the transmitter to the receiver.

The change in propagation characteristics through a conductive casing is generally much greater than the changes through various earth strata. Furthermore the geometrical factors of the casing are important in that the diameter of the casing is generally small compared to a wave length and not much larger than the diameter of the antenna. In order to account for the effect of the presence of one or more casings, it is usually advantageous to employ formulas such as those published by Saul Shenfeld in the article "Shielding of Cylindrical Tubes" which appeared on pages 29 to 34 of the IEEE Transactions on Electromagnetic Compatibility, Vol. EMC-10, No. 1, March 1968. These formulas give the ratio of magnetic fields inside the casing to fields outside the casing. The effect is equivalent to replacing the combination of the antenna inside the casing by a less effective antenna without a surrounding casing.

The voltage induced in a solenoidal antenna is proportional to the time derivative of magnetic flux within the winding. Therefore in a uniform magnetic field of density $B = \mu H$ and the angular frequency $\omega = 2\pi f$, the induced voltage is $V = \omega\mu H A_e$, where $A_e$ has the dimensions of area and represents the ability of the permeable core 17 to concentrate magnetic flux. The power available at the antenna terminals is proportional to $V^2$, and can be shown to be $$P_R = \frac{f^2 \mu H^2 S_R}{4B_R}, \qquad \text{Eq. (7)}$$

where H is the field component parallel to the antenna axis, $S_R$ is the antenna's effective volume, and $B_R$ is the antenna's intrinsic bandwidth, as defined in a publication titled "A Study of Low-Noise Broadband VLF Receiving Techniques" prepared by L. H. Rorden, September 1965 and available from the Defense Documentation Center Defense Supply Agency under document control No. AD 660 050.

The magnetic field which results from atmospheric noise must be considered, as well as that of the desired carrier signal, when estimating available power at the receiving antenna. The atmospheric noise component is generally negligible if the receiving antenna is buried deeper than a few wavelengths. However, thermal noises generated within the receiving antenna and its associated preamplifier must also be considered in calculating the minimum acceptable signal.

Using the above noise considerations and equations (5), (6), and (7), the transmitter power required for a given signal-to-noise ratio, M, bandwidth, B, and carrier frequency, $f$, may be expressed as:

$$P_T = \frac{64\pi^2 k\, Tn\, M\, r^6 B^3}{f^2 S_R S_T |\Gamma|^2}, \qquad \text{Eq. (8)}$$

where $k$ = Boltzmann's constant = $1.38 \times 10^{-23}$ joules/degree K $T_n$ = the effective noise temperature $S_R$, $S_T$ = the effective volumes of the receiving and transmitting antennas B = the noise bandwidth of the system.

Figure 4:
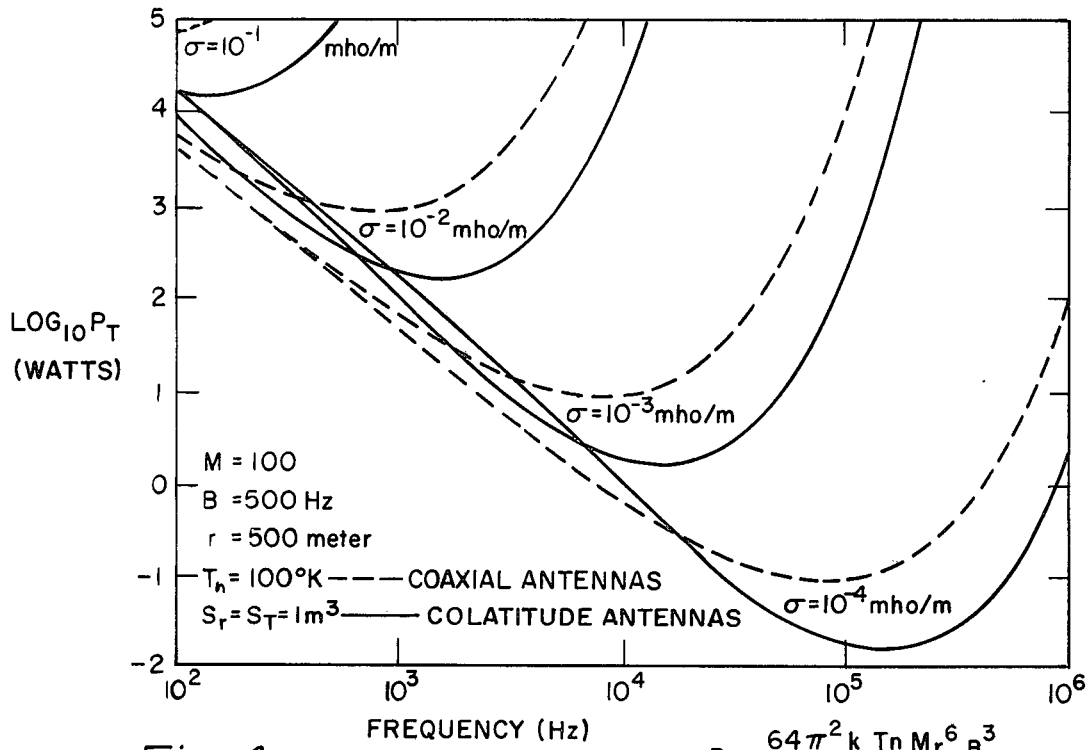
FIG. 4 is a plot of required transmitter power versus carrier frequency.

The behavior of $P_T$ as a function of frequency is illustrated in FIG. 4 for conditions that might be typically encountered for a data transmission system. There is a broad region around the "optimum" frequency at which the signal-to-noise ratio is maximized or the transmitter power minimized. For the case of coaxial antennas (only $H_r$ component considered), the optimum frequency is such that the range is 2.83 times the skin depth. For parallel antennas at equal elevation (only $H_\theta$ component considered), the optimum range is 3.86 times the skin depth.

Figure 5:
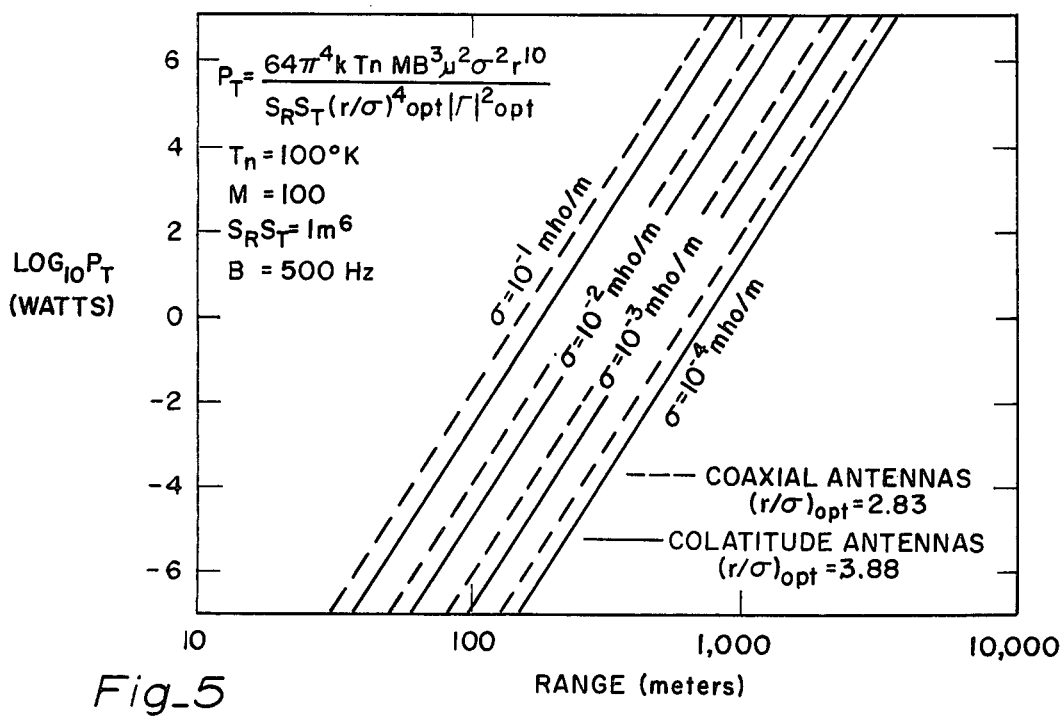
FIG. 5 is a plot of required transmitter power at optimum frequency versus range for coaxial and colatitude arrangements of the transmitting and receiving antennas.

The transmitter power required at the optimum frequency is proportional to the tenth power of range, as illustrated in FIG. 5. The frequencies of interest in the communication system of the present invention range from a high frequency of a few hundred KHz to low frequencies of a few Hz.

TEST RESULTS

Figure 6:
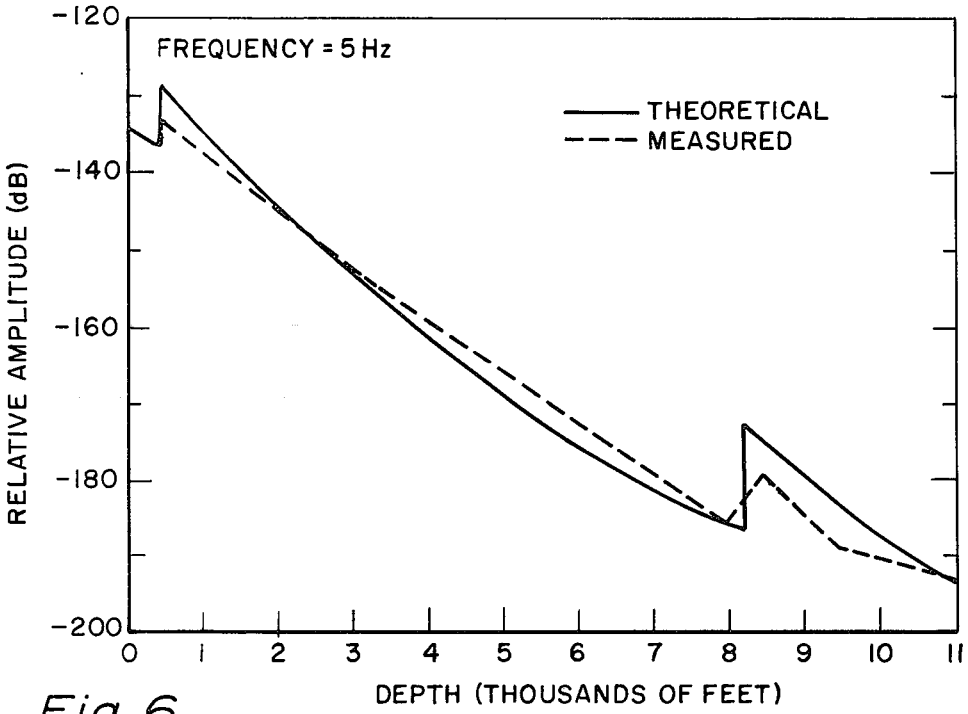
FIGS. 6–8 are plots of relative signal amplitude versus depth for carrier frequencies of 5Hz, 10Hz and 20Hz, respectively, each plot showing measured and theoretical values.
Figure 7:
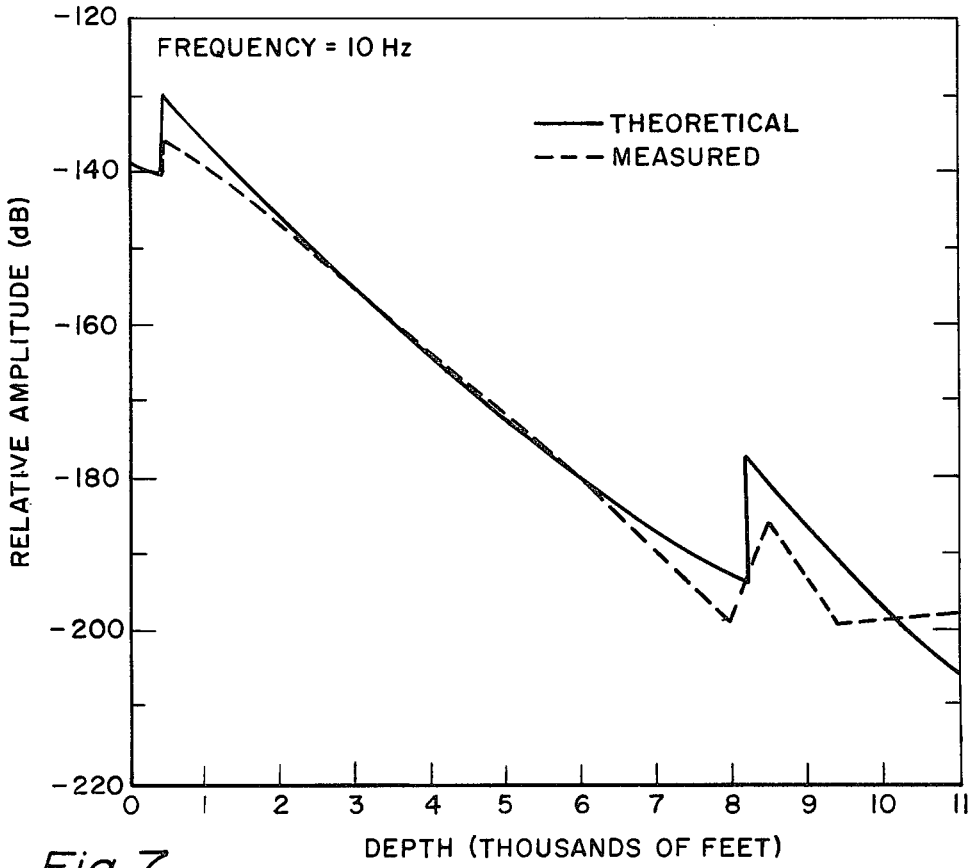
Figure 8:
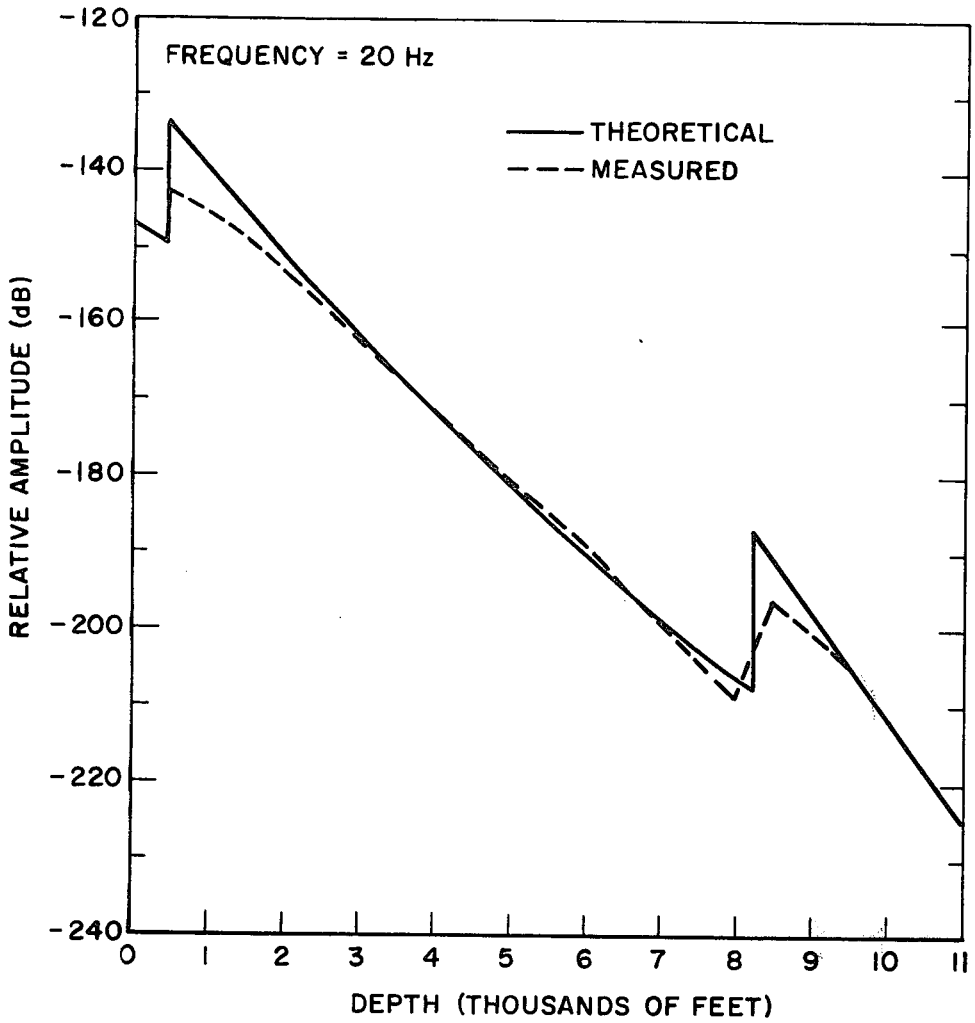

Referring now to FIGS. 6–8, there is shown the test results for three different frequencies, namely, 5Hz, 10Hz, and 20Hz for a communication link which included a transmitting loop 21 of a diameter of 2400 feet with two parallel turns of No. 10 wire having a resistance of 3.7ohms. The transmitting antenna 21 was coaxially aligned with the bore hole 12 and rested upon the surface of the earth. The receiving antenna consisted of a solenoidal antenna 15. The receiving antenna 15 and receiver 18 were lowered through the casing 14 having dimensions as previously described.

No earth resistivity measurements were made to a depth of 3000 feet. However, at depths between 3000 feet and 8200 feet the resistivity was measured and generally varied from 10 to 80 ohm-meters, while for depths between 8200 feet and 11,000 feet the resistivity varied from 2 to 30 ohm-meters. For the purpose of a simple theoretical calculation, the ground was assumed to be two slabs with a discontinuity at 8100 feet. The earth's conductivity above that depth was assumed to be 0.05 mho/meter, while a value of 0.25 mho/meter was assumed below that depth. The receiving antenna 15 had a measured effective volume of 0.4 $m^3$. The intrinsic bandwidth of the antenna was approximately 100Hz, and a system noise temperature of 500°K was assumed. The receiver bandpass filter (located prior to the coherent detector) was designed to have a 20-dB attenuation at the third harmonic of the transmitter frequency. This gave a 3-dB bandwidth of 0.27 times the center frequency, or a noise bandwidth of 0.4 times the center frequency. Post detection filtering bandwidth for the receiver was 0.025Hz. The receiving antenna 15 and receiver 18 were lowered down the bore hole 12 within the casing 14 with stops being made at the following depths: 400 feet, 500 feet, 1500 feet, 3500 feet, 6000 feet, 8000 feet, 8500 feet, 9500 feet and 11,000 feet. The theoretical and measured test results are shown in FIGS. 6–8 for the three frequencies utilized. The discontinuities at 400 feet and 8000 feet are due to the discontinuities in the casing. The inner casing extended beyond 11,000 feet.

Theoretical computations show that the optimum frequency for communication to the 11,000 foot depth is below 5Hz. The test results show that electromagnetic communications were received by the receiver in the cased well at depths exceeding 2 miles. The source of signals was a 100watt transmitter and the antenna 21 at the surface.

As used herein a vertically polarized magnetic dipole antenna is defined as any magnetic dipole antenna having a vertical component of magnetic moment exceeding in amplitude its horizontal component. Likewise, a vertically polarized magnetic field is defined as any magnetic field having a vertical component of magnetic field exceeding in amplitude its horizontal component of magnetic field.

What is claimed is:

1. In a method for establishing a wireless communication link through a subterranean region of earth or water the steps of:

disposing a first magnetic dipole antenna vertically in a subterranean location so as to have the magnetic dipole thereof oriented vertically;

disposing a second magnetic antenna in spaced apart relation from said first magnetic antenna, said first and second antennas being spaced apart by an intervening subterranean region of earth or water;

exciting one of said magnetic antennas with time varying excitation so as to set up at said excited antenna a vertically polarized time varying magnetic field and passing said time varying magnetic field through the intervening subterranean region of earth or water between said first and second magnetic antennas; and receiving and detecting the time varying magnetic field as passed between said first and second antennas.

2. The method of claim 1 wherein the step of disposing first magnetic dipole antenna in a subterranean location comprises the step of forming a long generally vertical narrow bore hole in the earth's crust and disposing said first magnetic dipole antenna in the narrow hole.

3. The method of claim 1 including the step of spacing apart the first and second antennas by a distance within the range less than ten skin depths in the intervening region of earth or water at the frequency of the time varying magnetic field.

4. In a method for establishing a subterranean wireless communication link to a subterranean location within a generally vertical bore hole in the earth's crust, the steps of:

lowering a first magnetic dipole antenna down the bore hole to a subterranean location, said bore hole being at least partially cased with steel casing over a length thereof between the subterranean location of said first antenna and the upper terminus of the bore hole;

orienting said first magnetic dipole antenna vertically at the subterranean location so as to set up at said antenna when excited with time varying excitation a vertically polarized magnetic field;

placing a second magnetic antenna in vertically spaced relation from said first magnetic antenna such that said first and second antennas are vertically spaced apart by an intervening region of earth;

exciting one of said magnetic antennas with time varying excitation so as to set up at said excited antenna a vertically polarized time varying magnetic field and passing said time varying magnetic field through the intervening subterranean region of earth or water between said first and second antennas; and receiving and detecting the time varying magnetic field as passed between said first and second antennas.

5. The method of claim 4 including the step of spacing apart said first and second magnetic antennas by a distance within a range of less than ten skin depths in the intervening region of earth or water at the frequency of the time varying magnetic field.

6. The method of claim 4 wherein said first magnetic dipole antenna comprises an electrically conductive solenoidal winding, and including the step of magnetically coupling said solenoidal winding to a core of ferromagnetic material such that when the electrically conductive winding is energized with current a magnetic dipole of increased magnetic moment is formed in said core.

7. The method of claim 6 including the step of making the core of said magnetic antenna of a material selected from the group consisting of ferrite and laminated iron alloys.

8. In a method for establishing a relatively low frequency wireless electromagnetic communication link through a subterranean lossy medium such as lossy ground or water the steps of:

disposing a first magnetic dipole antenna in the subterranean lossy medium through which the wireless communication link is to be established;

disposing a second magnetic dipole antenna in spaced apart relation from said first magnetic dipole antenna;

said first magnetic dipole antenna including an electrically conductive winding, and magnetically coupling said winding to a core of ferromagnetic material such that, when the electrically conductive winding is energized with current, a magnetic dipole of increased magnetic moment is formed in said core;

energizing one of said magnetic dipole antennas with time varying current to set up a time varying magnetic field and to cause said magnetic field to pass through said intervening region of the lossy medium to said other magnetic dipole antenna;

orienting said other magnetic dipole antenna so as to receive thereon the magnetic field passing from said one magnetic dipole antenna to said other antenna;

detecting the received magnetic field to derive an output therefrom, thereby establishing a wireless communication link between said first and second antennas through the intervening region of the lossy medium; and orienting one of said magnetic dipole antennas so as to set up when energized a vertically polarized magnetic field thereat.

9. The method of claim 8 wherein said ferromagnetic core of said first magnetic dipole antenna is elongated.

10. The method of claim 8 wherein said other magnetic dipole antenna, which received the magnetic field passing from the energized magnetic dipole antenna, is disposed within the range of less than 10 skin depths in the intervening region of earth or water at the frequency of the time varying magnetic field passing from said energized magnetic dipole antenna.

11. The method of claim 8 wherein said first and second magnetic dipole antennas are generally axially parallel.

12. The method of claim 8 wherein said second magnetic dipole antenna is vertically displaced from said first magnetic dipole antenna.

13. The method of claim 8 wherein said second magnetic dipole antenna is located generally at the surface of the earth and said first magnetic dipole antenna is located at a depth of at least 1000 feet below the surface of the earth.

14. The method of claim 8 wherein the core of said first magnetic dipole antenna is made of a material selected from the group consisting of ferrite and laminated iron alloys.

15. In an apparatus for establishing a wireless communication link through a subterranean region of earth or water;

a first magnetic dipole antenna disposed in a subterranean location and oriented vertically so as to have the magnetic dipole thereof oriented vertically;

a second magnetic antenna disposed in spaced apart relation from said first magnetic antenna, said first and second antennas being spaced apart by an intervening subterranean region of earth or water;

means for exciting one of said magnetic antennas with time varying energization for setting up a vertically polarized magnetic field for passing as a time varying magnetic field through the intervening subterranean region of earth or water between said first and second magnetic antennas; and means coupled to at least one of said antennas for receiving and detecting the time varying magnetic field having passed through said intervening region of earth between said first and second antennas.

16. The apparatus of claim 15 wherein said first magnetic dipole antenna is disposed in a long generally vertical narrow bore hole in the earth's crust.

17. The apparatus of claim 15 wherein said first and second antennas are spaced apart by a distance within the range less than ten skin depths in the intervening region of earth of water at the frequency of the time varying magnetic field.

18. In an apparatus for establishing a subterranean wireless communication link to a subterranean location within a generally vertical bore hole in the earth's crust:

first magnetic dipole antenna means disposed within the bore hole vertically so as to have the magnetic dipole thereof oriented vertically, the bore hole being at least partially cased with steel casing over a length thereof between the subterranean location of said first magnetic dipole antenna and the upper terminus of the bore hole;

a second magnetic antenna disposed in vertically spaced relation from said first magnetic dipole antenna such that said first and second antennas are vertically spaced apart by an intervening region of earth;

means for exciting one of said antennas with time varying energization for setting up a vertically polarized magnetic field and for passing said magnetic field from one of said antennas as a time varying magnetic field through the intervening subterranean region of earth or water to the other of said first and second antennas; and means coupled to one of said antennas for receiving and detecting the time varying magnetic field passed through the intervening region of earth or water between said first and second antennas.

19. The apparatus of claim 18 wherein said first and second magnetic antennas are spaced apart by a distance within a range of less than ten skin depths in the intervening region of earth or water at the frequency of the time varying magnetic field.

20. The apparatus of claim 18 wherein said first magnetic dipole antenna includes a core of ferromagnetic material and an electrically conductive solenoidal winding wound around said core such that when said electrically conductive winding is energized with current a magnetic dipole is formed in said core.

21. The apparatus of claim 20 wherein said core of said magnetic antenna is made of a material selected from the group consisting of ferrite and laminated iron alloys.

22. In an apparatus for establishing a relatively low frequency wireless electromagnetic communication link through a subterranean lossy medium such as lossy ground or water:

a first magnetic dipole antenna disposed in the subterranean lossy medium through which the wireless communication link is to be established;

a second magnetic dipole antenna disposed in spaced apart relation from said first magnetic dipole antenna;

said first magnetic dipole antenna including a core of ferromagnetic material and an electrically conductive winding wound around said core such that when said electrically conductive winding is energized with current a magnetic dipole is formed in said core;

means for energizing one of said magnetic dipole antennas with time varying current to cause a time varying magnetic field to emanate therefrom and to pass through said intervening region of the lossy medium to said other magnetic dipole antenna;

receiving means coupled to said other magnetic dipole antenna for receiving and amplifying the received magnetic field energy emanating from said one magnetic dipole antenna;

detecting means for detecting the received magnetic field to derive an output therefrom, thereby establishig a wireless communication link between said first and second antennas through the intervening region of the lossy medium; and said energized one of said magnetic dipole antennas being oriented so as to have the magnetic dipole thereof oriented vertically.

23. The apparatus of claim 22 wherein said ferromagnetic core of said first magnetic dipole antenna is elongated.

24. The apparatus of claim 22 wherein said other magnetic dipole antenna, which receives the magnetic field emanating from the energized magnetic dipole antenna, is disposed within the range of less than ten skin depths from the energized antenna in the intervening region of earth of water at the frequency of the time varying magnetic field emanating from said energized magnetic dipole antenna.

25. The apparatus of claim 22 wherein said first and second magnetic dipole antennas are oriented with their respective magnetic dipoles in general parallelism.

26. The apparatus of claim 22 wherein said second magnetic dipole antenna is vertically displaced from said first magnetic dipole antenna.

27. The apparatus of claim 22 wherein said second magnetic dipole antenna is located generally at the surface of the earth and said first magnetic dipole antenna is located at a depth of at least 1,000 feet below the surface of the earth.

28. The apparatus of claim 22 wherein the core of said first magnetic dipole antenna is made of a material selected from the group consisting of ferrite and laminated iron alloys.

* * * * *